United States Patent [19]

Stricklin et al.

[11] 4,374,174

[45] Feb. 15, 1983

[54] COMPOSITION AND SHEET MATERIALS FOR INHIBITING CORROSION OF METALS

[75] Inventors: Hazel R. Stricklin; George W. Morrow, Jr., both of Cullman, Ala.

[73] Assignee: Daubert Industries, Inc., Oak Brook, Ill.

[21] Appl. No.: 234,092

[22] Filed: Feb. 12, 1981

[51] Int. Cl.[3] ..... B32B 15/10; B32B 15/12; B65B 11/00

[52] U.S. Cl. ..... 428/341; 53/428; 53/461; 53/472; 106/14.05; 229/87 R; 252/389 R; 422/8; 427/391; 427/393.5; 428/342; 428/457; 428/464

[58] Field of Search ..... 422/8, 6, 9; 405/216, 405/211; 106/14.13, 14.36, 14.28, 14.05; 252/389 R; 428/341, 342, 464, 457; 53/428, 461, 472; 229/87 R; 427/391, 393.5

[56] References Cited

U.S. PATENT DOCUMENTS 2,726,215 12/1955 Jones ..... 252/389 R 3,405,072 10/1968 Kinnavy ..... 252/389 R 3,490,737 1/1970 Gieseking et al. ..... 252/389 R X 3,850,823 11/1974 Kjonaas ..... 252/389 R X

FOREIGN PATENT DOCUMENTS 739271 10/1955 United Kingdom ..... 422/8

*Primary Examiner*—Thurman K. Page

*Attorney, Agent, or Firm*—Wallenstein, Wagner, Hattis, Strampel & Aubel

[57] ABSTRACT

Compositions and sheet materials for inhibiting the corrosion of metals, particularly aluminum and ferrous metals, and alloys thereof. The compositions comprise as their essential active ingredient an alkali metal salt of an unsaturated organic acid, especially a potassium salt of an acrylic acid such as sorbic acid. The compositions, when embodied in, or carried on, various sheet materials, provide protection for metal surfaces both in direct contact with the sheet materials as well as for those areas of the metal surfaces not in direct contact with the sheet materials.

16 Claims, No Drawings

COMPOSITION AND SHEET MATERIALS FOR INHIBITING CORROSION OF METALS

The present invention relates to compositions, and sheet materials carrying the compositions, for preventing and inhibiting the attack on the surfaces of metals by elements, particularly moisture, normally present in the atmosphere.

Newly rolled, cast, or milled aluminum metal has a tendency to condense moisture on the surface thereof which will eventually cause corrosion. Normally, the corrosion manifests itself as "spotting." This condition can progress to the formation of a white powder on the surface of the metal which, in turn, is accompanied by surface pitting. Surface spotting due to moisture, and eventual surface oxidation are also encountered with newly fabricated galvanized steel or iron, and certain carbon steels. In the case of aluminum sheeting, sanding off a water spotted area will not remove internal corrosion which can cause premature stress failure in aluminum sheeting. This problem can have serious consequences in those instances where the aluminum sheeting is to be used in fabricating the "skin" of airplanes, for example.

Heretofore, attempts to meet the problems of spotting and oxidation of metal surfaces have involved encasing the metal surfaces in neutral or oil impregnated Kraft paper. However, these expedients are ineffective in providing protection to those surface areas not in direct contact with the paper. Thus, by way of illustration, where oil impregnated Kraft paper is interleaved between sheets of newly rolled aluminum, the paper does not protect the edges of the metal sheets where there is no contact with the paper. Water spotting and corrosion, therefore, can occur along these exposed areas. A further problem with using oil impregnated Kraft paper for this purpose, and one which adds appreciably to the cost of using it, is the necessity for removing the oil residue left on the metal surfaces after the paper is stripped off and before the metal is used.

In accordance with the present invention, compositions, and sheet materials carrying the compositions, have been evolved which effectively prevent water spotting, and inhibit corrosion of new metal surfaces caused by moisture or exposure to the atmosphere. These results are achieved, moreover, on metal surfaces in direct contact with the sheet materials and the areas thereof not in direct contact therewith. Stated differently, the compositions, quite surprisingly, act as both contact inhibitors and vapor phase inhibitors for new metal surfaces. What is more, the compositions do not leave any residue, or otherwise adversely affect a metal surface on which sheet materials carrying them have been applied.

The compositions of this invention comprise as an essential active ingredient an alkali metal salt of an unsaturated organic acid. The preferred acid is a polyunsaturated acrylic acid such as sorbic acid, and the preferred salt is potassium sorbate.

In accordance with a preferred practice of the invention, the sorbic acid salts are employed in conjunction with an inert liquid carrier which is a solvent for the salt used. Among the various liquid carriers which can be utilized in this connection are water, mineral spirits, and various straight and branched chain alcohols exemplified by isopropyl alcohol, isobutyl alcohol, and the like.

The proportion of the sorbic acid salt employed in the compositions is variable. Generally speaking, in those instances where water is used as the liquid carrier, the compositions comprise from about 10% to about 70%, usually about 25% to about 35%, by weight, of the salt.

The compositions advantageously are incorporated into or upon a suitable solid carrier or support member which may be a sheet of paper, including Kraft paper, a woven material, a non-woven material, or a plastic sheet or foam material. Impregnation or coating of a solid carrier such as Kraft paper may be attained by dipping, brushing, spraying, roller coating, or other ways known in the art. Where the solid carrier is a plastic sheet material such as polyethylene, polyvinylidene chloride (SARAN), or the like, the active ingredient desirably is dissolved in a volatile organic solvent which is then applied to a surface of the plastic sheet material, and thereafter evaporating off the solvent.

When the compositions are embodied or incorporated into a solid carrier or support member, excellent results are obtained when the active ingredient, that is, the sorbic acid salt is present in a concentration of from about 0.1 to about 10 grams per square foot of surface of the carrier sheet. In the usual case, the active ingredient is very effective when it is present in or on the carrier sheet in an amount in the range of from about 0.5 to about 3 grams per square foot of sheet surface area.

The sheet materials of this invention may be used to advantage as an interleaver for stacked aluminum or galvanized steel sheets or "skins," or as 100% overwrap materials. As indicated, the compositions provide excellent inhibiting action on a metal surface in direct contact therewith as well as for areas of the metal surface not in direct contact. While the compositions have special utility in preventing water spotting of the surfaces of metals such as aluminum, galvanized steel and iron, in addition to carbon steels, the compositions are also effective as corrosion inhibitors for such metals as nickel, lead, antimony, Babbitt alloys, and solder.

The following comparative test procedure was carried out using 35 lb Kraft paper impregnated with potassium sorbate to a loading of about 1 gram per square feet of surface area; oil impregnated 30 lb Kraft paper; 35 lb natural neutral Kraft paper; and a commercially available corrosion inhibiting sheet material incorporating as active ingredients sodium nitrite benzoic acid, and diethanolamine. The test was conducted using the sheets as interleaves between test panels of aluminum, and as 100% overwraps for the panels.

The interleaf test procedure involved sandwiching two aluminum test panels, cut to $1\frac{1}{2}'' \times 2''$, between 3 pieces of protective paper also cut to $1\frac{1}{2}'' \times 2''$. All pieces were placed in the same direction, and the treated side of the paper was placed up against the bottom metal panel and down against the top metal panel. Double strands of thread were used to hold the metal/paper sandwich together. The sandwich did not have paper covering the edges of the metal panels. The sandwich was suspended in a one quart glass jar having a water-tight lid. The jar with the metal/paper sandwich was placed in a freezer for 7 days. After 7 days, the jar was removed from the freezer and immediately placed in a ventilated oven at 85° F., where it remained undisturbed for 7 days. After 7 days in the oven, the sandwich was unwrapped and examined. The 100% overwrap test differed from the interleaf test in that the paper being tested was cut into a $5'' \times 5''$ square and the aluminum panels were drug-store wrapped therein. The results of both tests are set forth in the following table:

| Product Under Test | 100% Overwrapped | Interleaved |
|---|---|---|
| 1. Potassium sorbate in 35 lb Kraft | Excellent—Shiny all over. | Excellent protection outside, edges and in between panels. Very shiny. |
| 2. Oil Impregnated 30 lb Kraft | Heavy black corrosion on both sides and edges of panel. | Very heavy black corrosion on the outside and edges of both panels. Between the panels were corroded also, but not as heavy. |
| 3. Control 35 lb Natural Neutral Kraft | Dark gray corrosion sides and edges. | Dark gray corrosion on the outside, edges, and in between panels. |
| 4. Sodium nitrite, benzoic acid and diethylaminoethanol in 35 lb Kraft | Spots of gray corrosion on one side of panel. | Spots of dark corrosion on outside and edges of panels. Interleaved areas remained shiny between panels. |

What is claimed is:

1. A corrosion inhibiting composition for inhibiting corrosive attack on metal surfaces by elements normally present in the atmosphere comprising as the essential active ingredient an alkali metal salt of sorbic acid, said active ingredient being characterized in that it acts both as a contact and as a vapor phase corrosion inhibitor with respect to a metal surface.

2. A method of inhibiting corrosive attack on metal by elements normally present in the atmosphere comprising wrapping the metal in a sheet material embodying potassium sorbate, said sheet material acting to inhibit corrosive attack on the surfaces of the metal in those areas in direct contact with the sheet material as well as the areas thereof not in contact with the sheet material.

3. A method according to claim 2 wherein the metal is aluminum.

4. A composition according to claim 1 wherein the active ingredient is incorporated in a liquid carrier which is a solvent for same, the active ingredient comprising from about 10% to about 70%, by weight, of the solution.

5. A composition according to claim 1 wherein the active ingredient is potassium sorbate.

6. A composition according to claim 4 wherein the liquid carrier is water.

7. An article of manufacture which acts as a contact and a vapor phase inhibitor for inhibiting the corrosion of metals comprising a solid carrier in sheet form having incorporated therein as an essential active ingredient an alkali metal salt of sorbic acid.

8. An article according to claim 7 wherein the salt is potassium sorbate.

9. An article according to claim 7 wherein the active ingredient is present in a concentration of from about 0.1 to about 10 grams per square foot of surface area of the solid carrier.

10. An article according to claim 8 wherein the potassium sorbate is present in a concentration of from about 1 to about 3 grams per square foot of surface area of the solid carrier.

11. An article according to claim 7 wherein the solid carrier is paper sheet stock.

12. An article according to claim 7 wherein the solid carrier is a plastic sheet material.

13. A method of inhibiting water spotting on stacked newly formed metal sheet stock comprising interleafing between successive layers of the metal sheet stock a layer of a paper sheet stock having incorporated therein potassium sorbate, the dimensions of the paper sheet stock being substantially equal to the dimensions of the metal sheet stock.

14. A method according to claim 13 wherein the metal sheet stock is fabricated of aluminum.

15. A method according to claim 13 wherein the metal sheet stock is fabricated of galvanized steel.

16. A method according to claim 13 wherein the concentration of the potassium sorbate in the paper sheet stock is from about 1 to about 3 grams per square foot of surface area of the paper sheet stock.

* * * * *